US005624006A

United States Patent [19]

Richardson, Jr.

[11] Patent Number: 5,624,006

[45] Date of Patent: Apr. 29, 1997

[54] SUPPORT APPARATUS FOR USE ON AN INCLINED ROOF

[76] Inventor: Gary P. Richardson, Jr., 1439 S. George St., York, Pa. 17403

[21] Appl. No.: 523,332

[22] Filed: Sep. 5, 1995

[51] Int. Cl.[6] ..... E04G 1/36; E04G 3/12

[52] U.S. Cl. ..... 182/45; 248/237; 182/206

[58] Field of Search ..... 248/237, 148; 182/45, 129, 206

[56] References Cited

U.S. PATENT DOCUMENTS

| | | | |
|---|---|---|---|
| 362,747 | 5/1887 | Higgins | 248/237 |
| 444,280 | 1/1891 | Pepin | 182/206 |
| 760,995 | 5/1904 | Johnson | 248/237 |
| 909,012 | 1/1909 | McCarty | 248/237 |
| 1,133,878 | 3/1915 | Nagel | 248/237 |
| 2,848,282 | 8/1958 | Weber . | |
| 3,526,296 | 9/1970 | Stevens | 182/45 |
| 4,048,924 | 9/1977 | Wibben | 104/245 |
| 4,132,287 | 1/1979 | Parolini | 182/45 |
| 4,311,207 | 1/1982 | Lurry | 182/45 X |
| 4,450,935 | 5/1984 | Gustavus | 182/45 |
| 4,646,877 | 3/1987 | Whan | 182/38 |
| 4,695,023 | 9/1987 | McCafferty | 248/238 |
| 4,972,922 | 11/1990 | Levine | 182/45 |
| 5,249,397 | 10/1993 | Monaco | 52/126.1 |

FOREIGN PATENT DOCUMENTS

| | | | |
|---|---|---|---|
| 49628 | 11/1934 | Denmark . | |
| 550143 | 12/1942 | United Kingdom | 182/45 |
| 2199069 | 6/1988 | United Kingdom . | |

*Primary Examiner*—Ramon O. Ramirez
*Assistant Examiner*—Stephen S. Wentsler
*Attorney, Agent, or Firm*—Richard C. Litman

[57] ABSTRACT

A support apparatus for scaling and working on an inclined roof made up of at least one ladder having a pair of ridge hooks to engage the roof ridge, a rotatable support frame secured to the ladder, and a pivotally mounted platform for support of workers and materials. The support frame includes a pair of horizontal members, a pair of vertical legs, and a cross brace assembly, attached to one another by a mechanism adapted to allow rotation of the legs of at least 180 degrees around the outside of the horizontal member from an axle formed by the cross brace. The ladder includes hollow rungs and an opening in each rail forming a tubular passage. Each of the legs have a tube horizontally attached to each end forming an opening for alignment with the ladder openings whereby a securing rod can be passed through the passage. The rod acts as a spindle upon which the legs rest to the outbound sides of the ladder. The cross brace assembly is a generally Z-shaped configuration made of a pair of cross braces having sliding members for vertical adjustment of the support frame to variously inclined roofs. The platform is pivotally mounted to each of the horizontal members by a trunnion for easy access to the rungs of the ladder below. A chimney-arm attachment is provided for partially encircling a chimney for added or sole support of the support apparatus from an existing chimney.

13 Claims, 3 Drawing Sheets

SUPPORT APPARATUS FOR USE ON AN INCLINED ROOF

BACKGROUND OF THE INVENTION

1. Field of the Invention

The present invention relates to a support apparatus for scaling and working on an inclined roof.

2. Description of the Prior Art

Portable staging for the purpose of building and repair on inclined roof surfaces is known in the art. Artisans require that the staging be safe, portable, convenient and simple to assemble, and useful for working on steeply inclined roofs, multiply pitched roofs, chimneys and the like. Various approaches to solve these needs have been taken, among which have included platforms with non-skid supports, platforms using ridge hook ladders laid directly on a pitched roof surface, and wheeled platforms variously secured to the roof. However, many disadvantages are associated with the prior art which leave a need to be filled by the present invention.

Various means using a ladder or ladder-like braces have been developed for support of large platforms for workers. For example, U.S. Pat. No. 2,848,282, issued on Aug. 19, 1958 to Weber describes a platform and adjustable support for use with a ladder. The support includes a pair of vertical flanged members, each having a parabolic notch in its base which allow the vertical supports to be removably perched on a rung of the ladder placed on an inclined roof. A pair of horizontal members, also notched at one end to perch on a rung, are permanently affixed to a horizontal wooden platform. When in place, each vertical member is pinned to one of the horizontal members to form a right angle, whereby a assembly which straddles two or more rungs of a ladder is formed. A first disadvantage of this invention is that, once the platform is constructed, the platform blocks the use of the underlying ladder and requires the user to scale the roof or the vertical members of the platform to reach the support platform. Moreover, the platform is very narrow and limited to the width of the rungs. Both of these elements add unnecessary limitations to the size of the structure and potential danger to its user.

United Kingdom 2,199,069 by Rackam published Jun. 29, 1988 describes a roof scaffolding which can be affixed between roof ladders having hollow rungs by means of collared bolts, washers and wing nuts inserted through the hollow rungs and secured to the scaffolding. A platform support frame with telescopic guard rails extends horizontally between the roof ladders. The scaffolding is adjustable to variously inclined roof angles by aligning holes drilled at critical points in the scaffolding and fixedly securing them by means of collared bolts, washers and wing nuts. The disadvantage of this system is that at least two roof ladders are required to support the platform support frame. Moreover, the securing bolts must be manually removed and the holes realigned to adjust the assembly to variously inclined roofs.

Danish Pat. No. 49628 issued Dec. 10, 1934 shows a platform with adjustable height legs straddling rungs of a ladder-like support placed to each of side of a chimney. The support is capable of either being hooked to a similar ladder-like support laid on the oppositely pitched roof surface or to a cross-brace affixed to the roof rafters of side of the roof on which the support rests.

U.S. Pat. No. 4,695,023 issued Sep. 22, 1987 to McCafferty describes a simple ladder-supported platform for use with small objects, the platform hinged to a pair of hooked supports for hanging from a single rung of a ladder, whereby the angle of inclination of the supports relative to the platform can be adjusted by aligning and securing registered apertures in a frame with a pin. This device does not appear to be intended for the safe support of workers over a large work area. A similar device is found in U.S. Pat. No. 4,450,935 issued May 29, 1984 to Gustavus using a crank and screw assembly to adjust the angle of inclination.

U.S. Pat. No. 5,249,397 issued Oct. 5, 1993 to Monaco describes a knockdown roof platform for small objects wherein an adjustable, tubular upright leg support having frictional pads for gripping an inclined surface is hinged by a collapsible locking bracket to the platform. The hinge secures the assembly when fully extended and closes to allow the legs to be folded against the platform for storage.

U.S. Pat. No. 3,526,296, issued on Sep. 1, 1970 to Stevens describes portable staging extending downward from the ridge of a roof, which utilizes a pair of rung-less braces with hooked, swiveling ends having non-slip pads for frictional engagement of the ridge. Individual vertical and horizontal elongated braces having bifurcated ends interlock by means of pins inserted through apertures defined by the bifurcated ends and the elongated portion of the braces. A scaffold can thus be assembled and disassembled piece by piece. However, the similarity of parts and the numerous pins needed to interlock each piece with another requires unnecessary time and a familiarity with the assembly of the structure. Multiple pieces increases the risk of loss of such pieces. Moreover, during assembly, no means of support for the user exists, requiring separate supports or ladders to be put in place for assembly.

Each invention comprising a group of wheeled platforms addresses specific problems regarding means by which the user can transport humans or materials on an inclined surface. For example, U.S. Pat. No. 4,048,924 issued Sep. 20, 1977 to Wibben describes an elongated skeletal frame to transport packets of roofing panels spanning purlins which run horizontally the length of a pitched roof. The skeletal frame is supported by a wheeled carrier which rides the purlins. U.S. Pat. No. 4,646,877 issued Mar. 3, 1987 to Whan describes a wheeled scaffold capable of carrying materials and men, having steps and wherein sets of first and second wheels ride roof purlins horizontally. U.S. Pat. No. 4,132,287 issued Jan. 2, 1979 to Parolini describes a wheeled carriage designed to support a scaffold platform and move the platform vertically along an inclined roof. The horizontal platform is variably adjustable relative to the carriage by means of a crank assembly; the mobile carriage is supported from a roof ridge by conventional support lines and lift mechanisms. However, none of these inventions address needs or problems by means related to the present invention.

None of the above inventions and patents, taken either singly or in combination, is seen to describe the instant invention as claimed.

SUMMARY OF THE INVENTION

The present invention relates to a support apparatus for scaling and working on an inclined roof. In the preferred embodiment, the support apparatus is an assembly of easily distinguishable and easily operable components. At least one ladder is provided having a pair of rails, hollow rungs being connected to the rails so that an opening in each rail exists forming a tubular passage, and ridge hooks at one end of each of the pair of rails. The ladder rests on the inclined surface and extends downward from the ridge of the roof from where it is frictionally engaged by the ridge hooks. Removably secured to the ladder is a support frame, including a pair horizontal members, a pair of vertical legs, and a cross brace assembly. The horizontal members support a platform for support of workers and materials, the platform being pivotally mounted to the horizontal members so that the platform may be easily tilted to an open or closed position to allow workers to access the rungs of the ladder during ascent upon and descent from the platform.

Each of the legs, having a first end and a second end, has a tubular opening attached to each first and second end. When each of a pair of legs are aligned so that the tubular openings are in registry with the openings on either end of one ladder rung, a rod can be inserted to pass through and beyond the unit formed by the tubular openings and the ladder rung. Each end of the rod protrudes beyond the tubular openings and serves as a spindle upon which each leg rests to the outbound sides of the rungs. The rod is in turn secured from lateral movement by any suitable means, but preferably by removable pins passing through an aperture in the portion of the rod which extends beyond the tubular openings.

Each of the legs are rotatably attached to the horizontal members by the cross brace assembly. The cross brace assembly serves as an adjusting mechanism for slidably raising or lowering one end of each horizontal member individually to match variously inclined roof angles. In the preferred embodiment, the cross brace assembly includes a pair of cross braces, each made up of a pair of slidable members connected to one another by an elongated rigid member. Each sliding member is adapted to closely and partially enclose a leg so that the leg rides vertically within a channel. The leg is capable of being secured by a removable pin passing through registered openings in the leg and sliding member. The pair of cross braces are rigidly connected to one another by a connecting member, forming either an H-shape or Z-shape. Although a single cross brace may be used in other embodiments, the pair of cross braces forming the cross brace assembly provides lateral rigidity to the entire support frame for added safety. A suggested second embodiment which may eliminate the need for a second brace involves using an elongated tubular sliding member with tubular legs.

The cross brace assembly secondly serves as an axle, allowing rotation of the legs of at least 180 degrees around the outside of the horizontal members, without the need to disassemble the support frame. Each horizontal member, having a proximate end and a distal end, has an annular member attached to its proximate end, through which the axle passes. When the axle is not directly centered on the midpoint of the length of each of the legs, an offset axle position results wherein a first portion of each of the legs to one side of the axle is longer than a second portion to the opposite side. Predetermined apertures in the legs may be located so that the lengths of the resulting first and second portions correspond to two commonly found roof pitches. Once the sliding member is set such a dual position, the legs simply can be rotated 180 degrees on the axle to correspond to two roof pitches without requiring any disassembly of the support frame.

For example, in instances where the support apparatus is moved from a greater pitched roof to a roof of a lesser pitch, by simply removing the rod securing the legs to the ladder, the legs and cross brace assembly are free to be rotated 180 degrees. Upon rotation, the rod is reinserted and secured, thus having changed the angle of inclination to correspond with the lesser pitch.

A chimney-arm attachment is provided to be used in secured combination with the ladder component for the added or sole support of the invention from an existing chimney. The chimney-arm rests in a valley formed between the chimney and the roof ridge while the ladder rests on an inclined roof next to one side of the chimney. The chimney-arm is adapted to pass through the hollow rung and secure the support frame to the ladder component by means of pins as previously described; however, the chimney-arm is a predetermined length sufficient to cross the face of the chimney in part forming the valley. The rod may be perpendicularly bent or hooked at its end to partially encircle the chimney.

Accordingly, it is a principal object of the invention to provide a support apparatus and platform for working upon inclined surfaces, adjustable to various surface pitches, and using hollow runged means for easy ascent to a work platform.

It is another object of the invention to provide a platform which is pivotally mounted to provide access to a runged means for ascent and descent.

It is a further object of the invention to provide a work platform on a rotatable support frame.

Still another object of the invention is to provide an attachment for use in combination with the support apparatus, adapted to secure the support apparatus from an existing chimney.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
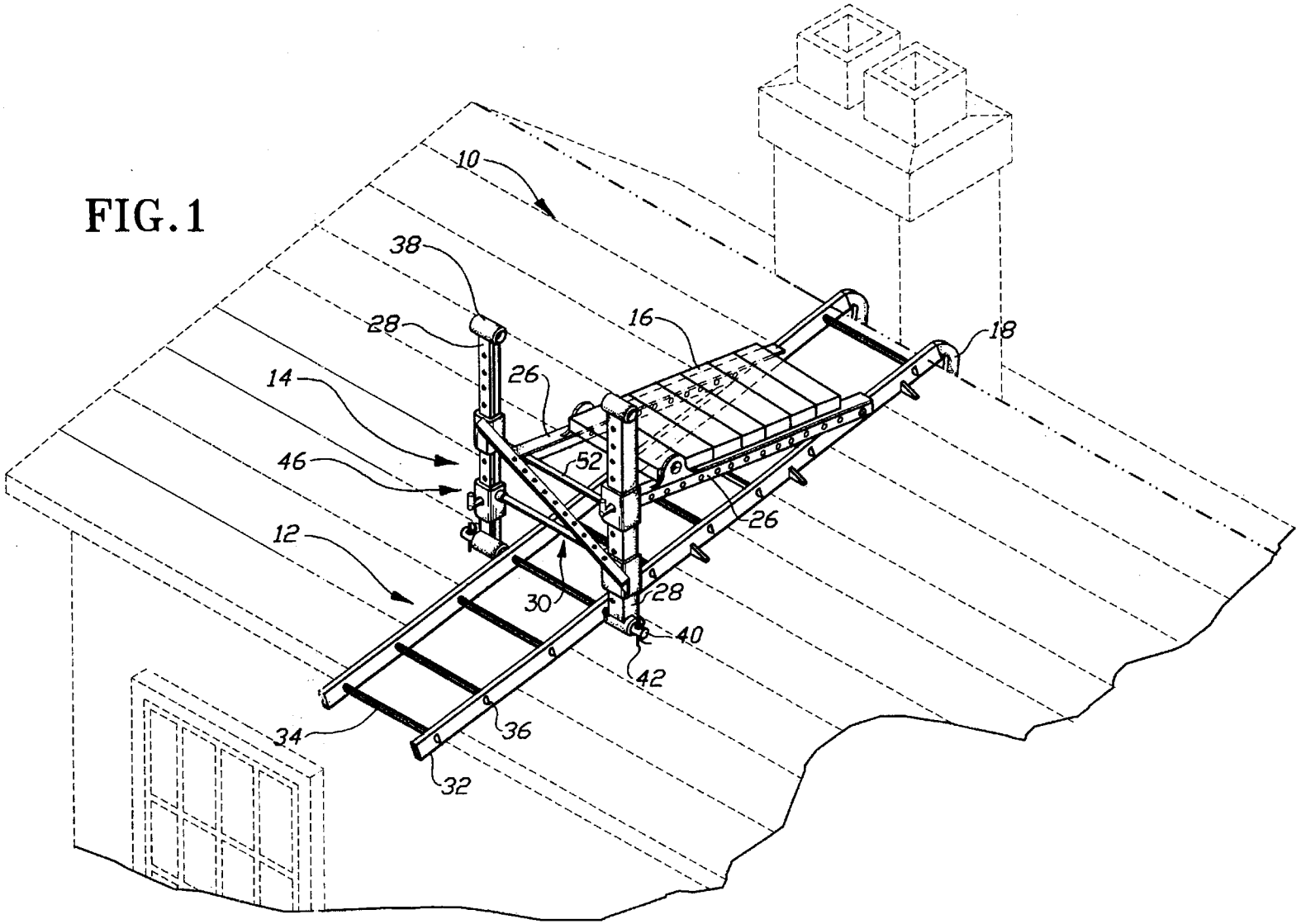
FIG. 1 is an environmental perspective view of the support apparatus in use on an inclined roof.
Figure 2:
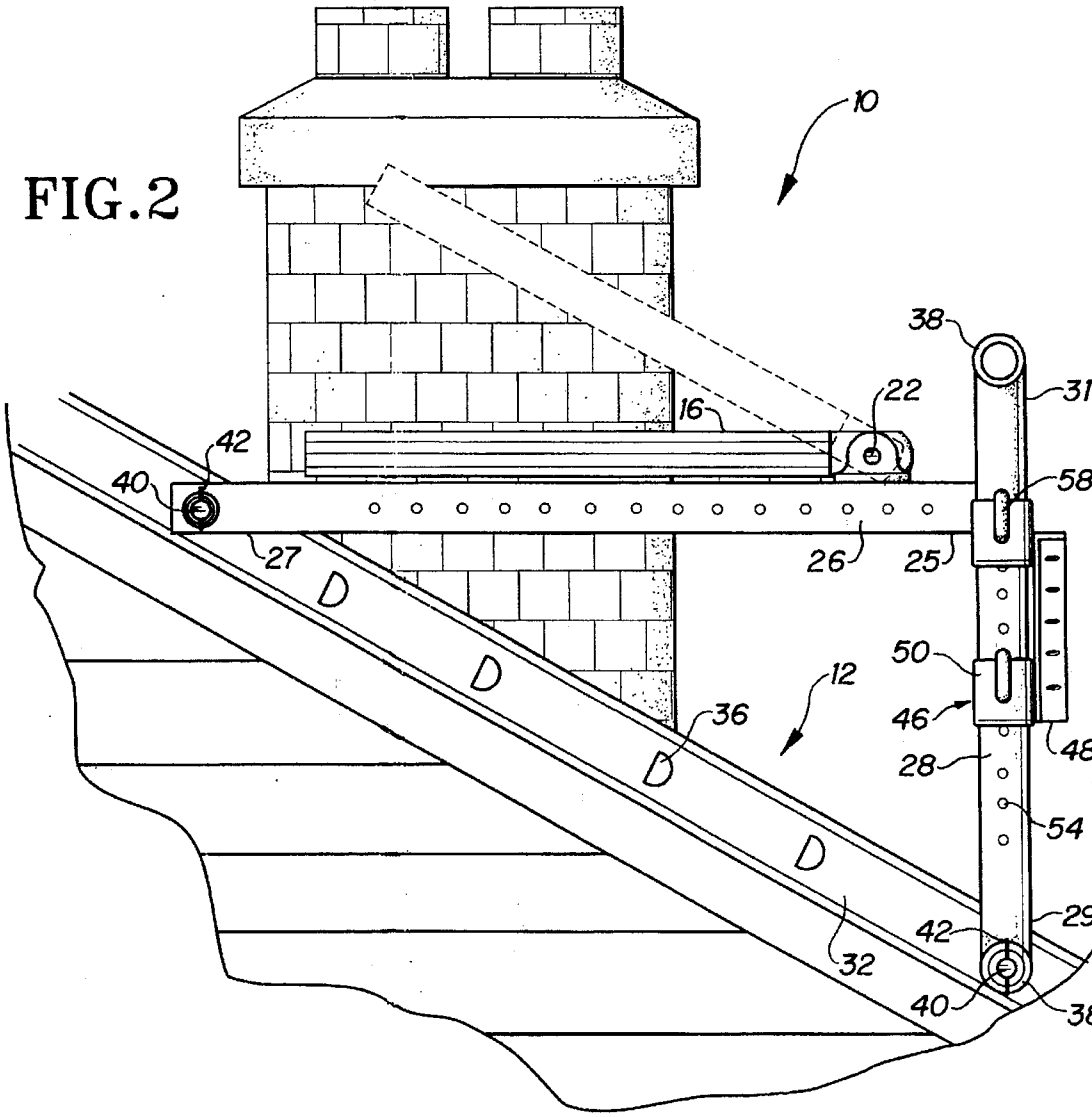
FIG. 2 is a side elevational view of the support apparatus in use on an inclined roof.

The present invention relates to a support apparatus for scaling and working on an inclined roof. Referring to FIG. 1 and FIG. 2, the support apparatus 10 is shown assembled in place on a pitched roof, made up of at least one ladder 12 having a pair of ridge hooks be, a support frame 14, and a platform 16 for support of workers and materials.

The ladder 12 in the preferred embodiment has a pair of rails 32. Hollow rungs 34 are affixed between each of the two rails 32 defining an opening 36, thereby forming a tubular passage. A ridge hook 18 is attached to the end of each of the pair of rails 32. The ridge hook 18 is adapted to frictionally engage the ridge of the roof by any conventional means so that the ladder rests on the inclined surface and extends downward from the ridge of the roof.

The support frame 14 includes a pair of horizontal members 26, a pair of vertical legs 28, and a cross brace assembly 30.

Figure 3:
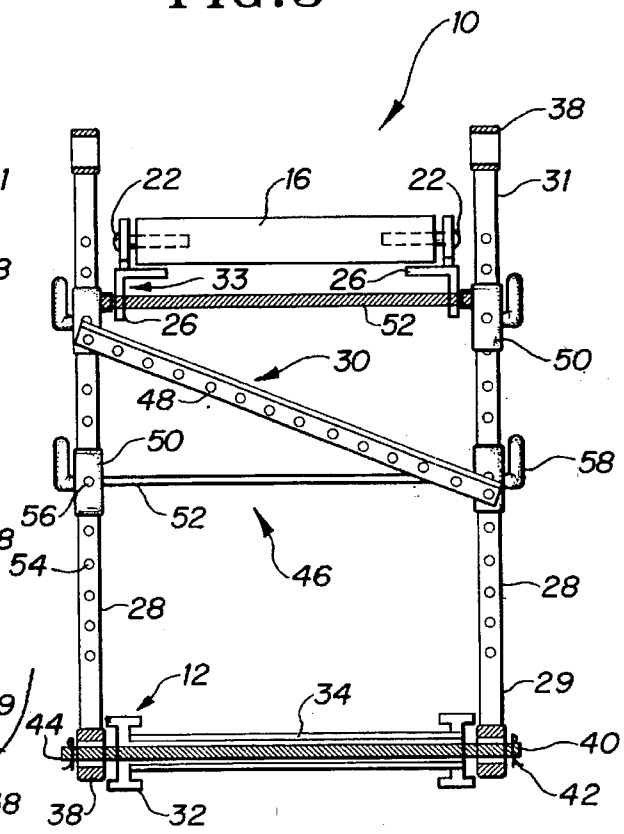
FIG. 3 is a front elevational view of the support apparatus.

As is more readily appreciated from FIG. 2 and FIG. 3, each of the legs 28, having a first end 31 and a second end 29, has a tube 38 horizontally attached to each first end 31 and second end 29. The opening of the tube 38 can be aligned with the openings 36 on either end of the ladder rung 34. As can be best appreciated from FIG. 3, a rod 40 can be passed through both the rung 34 and tubes 38. Each end of the rod 40 acts as a spindle upon which the legs 28 rest to the outbound sides of the ladder 12. The rod 40 is in turn secured from lateral movement by any suitable means, but preferably by removable pins 42 passing through an aperture 44 in the end of the rod which extends beyond the tubes 38.

Each of the horizontal members 26, having a proximate end 25 and a distal end 27, support the platform 16 by having the distal end 27 extending horizontally from a rung 34 and rotatably joining with the cross brace assembly 30 at the proximate end 25. As described above, a passage formed in the distal end 27 is used to removably attach the rod and pin system as described above to the rung 34. The platform 16 is pivotally mounted to each of the horizontal members 26 by a trunnion 22. Access to the rungs 34 of the ladder 12 is thus easily allowed by raising the platform The cross brace assembly 30 acts to securely, yet rotatably, connect the horizontal members 26 and legs 28. As is shown in FIG. 1 and FIG. 3, the cross brace assembly 30 is a generally Z-shaped configuration made of a pair of cross braces 46 rigidly connected to one another by a connecting member 48. Each cross brace 46 is further made up of a pair of slidable members 50 connected to one another by an elongated rigid member 52. Each sliding member 50 is adapted to closely grasp a leg 28 so that the leg rides vertically within a channel defined by the sliding member 50. The sliding member 50 further defines at least one aperture 56. The leg 28 defines a plurality of apertures 54 of which one may be brought into registry with the at least one aperture 56. Once so aligned, the leg 28 may be secured to the sliding member 50 by a removable pin 58 passing through each of apertures in registry.

Each of the legs 28 are attached to the horizontal members 26 by a means adapted to allow rotation of the legs of at least 180 degrees around the outside of the platform from an axle formed by the cross brace 46. As shown in FIG. 3, an annular passage 33 is integrally defined by the proximate end 25 of the horizontal member 26 through which the elongated rigid member 52 of the cross brace 46 passes. However, modifications of the passage may be made to allow removable attachment of the horizontal member 26 to the elongated rigid member As shown in FIG. 2, the axle is not directly centered on the midpoint of the length of each of the legs 28. Each leg 28 is thus divided into a long portion and a short portion resulting in an offset axle position. The plurality of apertures 54 in each of the legs 28 can be predetermined so that the short portion and long portion of the legs correspond to two commonly found roof pitches. Once the sliding member is set in this position, the legs simply can be rotated 180 degrees on the axle to correspond to two roof pitches without requiring any disassembly of the support frame.

Figure 4:
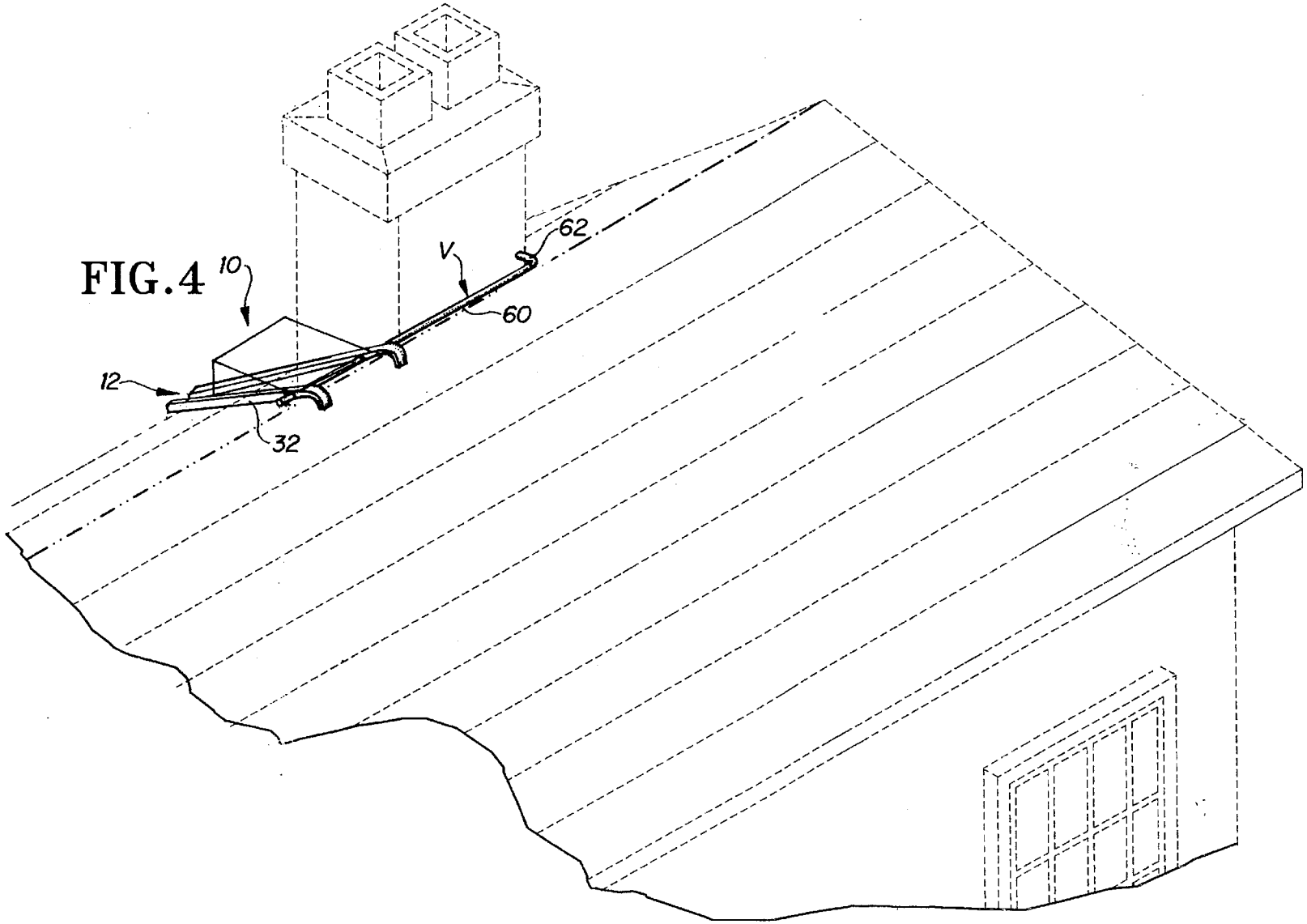
FIG. 4 is a environmental perspective view of the support apparatus in use in combination with a chimney-arm attachment.

Referring now to FIG. 4, a chimney-arm 60 attachment rests in a valley V formed between the chimney and the roof ridge while a representation of the ladder 12 and support apparatus 10 rests on an inclined roof next to one face of the chimney. In an identical manner as having been shown in FIG. 3, the chimney-arm 60 is adapted to pass through an opening 36 on either end of the ladder rung 34. The chimney-arm 60 is secured from lateral movement by any suitable means, but preferably by removable pins 42 passing through a apertures 44 in the chimney-arm defined in positions comparable those shown in the rod 40 in FIG. 3. However, the chimney-arm is effectively an extension of such rod 40 which extends beyond the tubes 38 of the legs 28. Referring again to FIG. 4, the chimney-arm 60 is a predetermined length sufficient to cross the chimney face in part forming the valley. The preferred embodiment of the chimney-arm 60 has perpendicularly bent or hooked end 62 to partially encircle the chimney for added or sole support of the support apparatus from an existing chimney.

It is to be understood that the present invention is not limited to the embodiments described above, but encompasses any and all embodiments within the scope of the following claims.

I claim:

1. A support apparatus for supporting workers and materials on an inclined surface comprising:

at least one ladder having at least two rails and further having hollow rungs defining openings of a predetermined dimension in said rails whereby an unobstructed continuous first passage is formed through said openings and said rungs; and a support frame operably attached to said at least one ladder, further comprising at least two vertical legs, each at least two vertical legs having a first end and a second end, said first end defining a second passage approximating said predetermined dimension of said openings and configured for concentric alignment with said openings, and said second end defining a third passage approximating said predetermined dimension of said openings and configured for concentric alignment with said openings, a cross brace assembly further comprising at least one cross brace, said cross brace further comprising a pair of slidable members affixed to one another by an elongated rigid member, each said slidable member defining a channel matingly adapted to one of said vertical legs for slidable travel of said leg within said channel, at least one elongated securing member adapted to closely pass through said first passage and selectively pass through said second or third passage of each of said vertical legs, and at least two horizontal members, each said horizontal member having a proximate end and a distal end, said distal end defining a fourth passage approximating said predetermined dimension of said openings and configured for concentric alignment with said openings, and said proximate end defining a fifth passage through which said elongated rigid member passes to rotatably join said proximate end to said cross brace assembly;

whereby a tiltable horizontal platform is supported by said horizontal members, each of said horizontal members is capable of being rotated at least 180 degrees about said cross brace assembly supporting said horizontal members, each of said vertical legs supporting said cross brace assembly is capable of being selectively and individually vertically adjusted to an inclined surface, and said support frame is secured to said ladder by said at least one elongated securing member.

2. The support apparatus according to claim 1, further comprising an engaging means for secure engagement of said ladder to an inclined surface.

3. The support apparatus according to claim 2, wherein said engaging means further comprise a pair of ridge hooks for frictional engagement of the roof surface, each of said pair of ridge hooks affixed to one end of each of said rails.

4. The support apparatus according to claim 1, wherein said platform is operably attached to said horizontal members and dimensioned to have a width of less than the distance between said at least two vertical legs.

5. The support apparatus according to claim 4, wherein said platform is pivotally mounted to each of said horizontal members.

6. The support apparatus according to claim 5, further comprising at least one trunnion for pivotally mounting said platform to said horizontal members.

7. The support apparatus according to claim 1, further comprising locking means to selectively and temporarily secure said slidable member to at least one of said legs at a predetermined position.

8. The support apparatus according to claim 7, wherein said locking means includes at least one pin, wherein further each said vertical leg defines a plurality of apertures, wherein further each said sliding member defines at least one aperture, wherein further each said aperture defined by said vertical leg and each at least one aperture defined by said sliding member are dimensioned and configured to be brought into registered alignment and receive said pin in close passage while in said registered alignment.

9. The support apparatus according to claim 1, wherein said cross brace assembly includes two cross braces rigidly connected to one another by a connecting member.

10. The support apparatus according to claim 1, wherein said second passage, said third passage, and said fourth passage are annular openings.

11. The support apparatus according to claim 1, wherein said elongated securing member further comprises at least one pin and a rod of a length sufficient to extend beyond the outbound sides of said rails thereby defining a pair of spindles for support of each of said vertical legs, each of said spindles defining an aperture for close passage of said at least one pin and said aperture positioned to prevent lateral movement of each of said vertical legs.

12. The support apparatus according to claim 11, wherein said rod is a chimney-arm adapted to partially encircle a preexisting chimney.

13. The support apparatus according to claim 1, wherein said fifth passage is adapted for removable attachment to said elongated rigid member.

* * * * *